US007063924B2

(12) United States Patent
Kaminsky et al.

(10) Patent No.: US 7,063,924 B2
(45) Date of Patent: Jun. 20, 2006

(54) SECURITY DEVICE WITH PATTERNED METALLIC REFLECTION

(75) Inventors: Cheryl J. Kaminsky, Webster, NY (US); Robert P. Bourdelais, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 176 days.

(21) Appl. No.: 10/327,533

(22) Filed: Dec. 20, 2002

(65) Prior Publication Data

US 2004/0121257 A1 Jun. 24, 2004

(51) Int. Cl.
*B41M 3/14* (2006.01)
*G03C 1/76* (2006.01)

(52) U.S. Cl. ..... 430/10; 430/11; 430/311; 430/201; 430/496; 156/235; 428/913; 428/914; 283/91

(58) Field of Classification Search ..... 430/311, 430/201, 496; 156/235; 428/913, 914
See application file for complete search history.

(56) References Cited

U.S. PATENT DOCUMENTS

| | | | | |
|---|---|---|---|---|
| 4,948,719 | A * | 8/1990 | Koike et al. | 430/524 |
| 5,369,419 | A | 11/1994 | Stephenson et al. | |
| 5,808,758 | A | 9/1998 | Solmsdorf | |
| 6,258,494 | B1 | 7/2001 | Bourdelais et al. | |
| 6,286,761 | B1 | 9/2001 | Wen | |
| 6,291,150 | B1 | 9/2001 | Camp et al. | |
| 6,326,109 | B1 | 12/2001 | Bourdelais et al. | |
| 6,344,310 | B1 | 2/2002 | Bourdelais et al. | |
| 6,468,379 | B1 | 10/2002 | Naito et al. | |
| 2002/0069956 | A1 | 6/2002 | Paulson | |
| 2002/0145049 | A1 | 10/2002 | Lasch et al. | |
| 2004/0115557 | A1 * | 6/2004 | Bourdelais et al. | 430/201 |

FOREIGN PATENT DOCUMENTS

| | | |
|---|---|---|
| DE | 43 43 387 | 6/1995 |
| EP | 1 419 895 | 5/2004 |
| GB | 2028719 | 3/1980 |
| WO | 96/07547 | 8/1995 |

* cited by examiner

*Primary Examiner*—John A. McPherson
*Assistant Examiner*—Daborah Chacko-Davis
(74) *Attorney, Agent, or Firm*—Paul A. Leipold

(57) ABSTRACT

The invention relates to an image device comprising a base material having a pattern of diffuse and specular metallic reflectivity and overlaying said pattern an image.

37 Claims, 2 Drawing Sheets

SECURITY DEVICE WITH PATTERNED METALLIC REFLECTION

FIELD OF THE INVENTION

The invention relates to security materials. In a preferred form it relates to the use of a pattern of diffuse and specular metallic reflectivity and an image for security purposes.

BACKGROUND OF THE INVENTION

The proliferation of transaction cards, which allowed the cardholder to pay with credit rather than cash, started in the United States in the early 1950s. Initial transaction cards were typically restricted to select restaurants and hotels and were often limited to an exclusive class of individuals. Since the introduction of plastic credit cards, the use of transaction cards have rapidly proliferated from the United States, to Europe, and then to the rest of the world. Transaction cards are not only information carriers, but also typically allow a consumer to pay for goods and services without the need to constantly possess cash, or if a consumer needs cash, transaction cards allow access to funds through an automatic teller machine (ATM). Transaction cards also reduce the exposure to the risk of cash loss through theft and reduce the need for currency exchanges when traveling to various foreign countries. Due to the advantages of transaction cards, hundreds of millions of cards are now produced and issued annually, thereby resulting in need for companies and individuals to protect against forgery and theft.

Initially, the transaction cards often included the issuer's name, the cardholder's name, the card number, and the expiration date embossed onto the card. The cards also usually included a signature field on the back of the card for the cardholder to provide a signature to protect against forgery and tempering. Thus, the initial cards merely served as devices to provide data to merchants and the only security associated with the card was the comparison of the cardholder's signature on the card to the cardholder's signature on a receipt along with the embossed cardholder name on the card. However, many merchants often forget to verify the signature on the receipt with the signature on the card.

Due to the popularity of transaction cards, transaction cards now also include graphic images, designs, photographs and security features. A recent security feature is the incorporation of a diffraction grating, or holographic image, into the transaction card which appears to be three dimensional and which substantially restricts the ability to fraudulently copy or reproduce transaction cards because of the need for extremely complex systems and apparatus for producing holograms. A hologram is produced by interfering two or more beams of light, namely an object beam and reference beam, onto a photoemulsion to thereby record the interference pattern produced by the interfering beams of light. The object beam is a coherent beam reflected from, or transmitted through, the object to be recorded, such as a company logo, globe, character or animal. The reference beam is usually a coherent, collimated light beam with a spherical wave front. After recording the interference pattern, a similar wavelength reference beam is used to produce a holographic image by reconstructing the image from the interference pattern. However, the ability to copy and reproduce holograms or to take them from one card and place them on another has decreased the usefulness as a security feature.

The transaction card industry started to develop more sophisticated transaction cards that allowed the electronic reading, transmission, and authorization of transaction card data for a variety of industries. For example, magnetic stripe cards, smart cards, and calling cards have been developed to meet the market demand for expanded features, functionality, and security. In addition to the visual data, the incorporation of a magnetic stripe on the back of a transaction card allows digitized data to be stored in machine readable form. As such, magnetic stripe reader are used in conjunction with magnetic stripe cards to communicate purchase data received from a cash register device on-line to a host computer along with the transmission of data stored in the magnetic stripe, such as account information and expiration date. The magnetic strips are susceptible to tampering, have a lack of confidentiality of the information within the magnetic stripe, and have problems associated with the transmission of data to a host compute.

U.S. Pat. No. 6,468,379 (Naito et al.) discloses a thermal donor and receiver where a security layer could be transferred as a donor layer to the thermal substrate. This forgery preventative layer could contain special decorative effect, hologram layer, a diffraction grating, or florescent materials. This layer would most likely be placed over the thermal image making it susceptible to scratches, wear, and tampering. Furthermore, the diffraction grating and hologram could not be customized for each print.

U.S. Pat. No. 6,286,761 (Wen) discloses an identification document with invisible but retrievable embedded information. While this invention provides a high level of security, a machine is required to read the information and determine the authenticity of the ID card. It would be desirable to have an easily viewable way of detecting the authenticity of a security document.

U.S. 20020145049 (Lasch at al.) discloses a process for producing an opaque, transparent or translucent transaction card having multiple features, such as a holographic foil, integrated circuit chip, silver magnetic stripe with text on the magnetic stripe, opacity gradient, an invisible optically recognizable compound, a translucent signature field such that the signature on back of the card is visible from the front of the card and an active through date on the front of the card. While together, these transaction cards with the multiple security features produce an ID card that is difficult to tamper with or counterfeit, it would be very difficult and expensive to customize each ID card.

U.S. 20020069956 (Paulson) discloses an overlaminate for application to identification card substrates includes a plurality of overlaminate patches. Each patch has an end and is sized in accordance with the identification card substrates. A security mark is located in a predetermined position on each patch. Overlaminates tend to be expensive and require special equipment for application. Furthermore, the overlaminate system does not allow for the customization of the patches or security marks.

U.S. Pat. No. 5,369,419 (Stephenson et al.) describes a thermal printing method where the amount of gloss on a media can be altered. The method uses heat to change the surface properties of gelatin, which has many disadvantages. Gelatin can not achieve high roughness averages, thereby having a low distinction between the matte and glossy areas of the media. This small distinction between the matte and glossy states lead to a low signal to noise ratio and when scanning, leading to scanning errors. Gelatin also is very delicate, scratch prone, is self-healing, tends to flow over time thus changing its surface roughness and other properties time especially in high humidity and heat, and is dissolved if placed in water. Also, gelatin has a native yellow color, is expensive, and is tacky sticking to other sheets and itself. It would be desirable to use a material that had no coloration, is more stable in environmental conditions, and could have a higher surface roughness.

PROBLEM TO BE SOLVED BY THE INVENTION

There is a need for customizable metallic diffuse and specular reflective security features that can provide security features for security media.

SUMMARY OF THE INVENTION

It is an object of the invention to provide security features for a security media.

It is another object to provide a security feature that can be customizable.

These and other objects of the invention are accomplished by an image device comprising a base material having a pattern of diffuse and specular metallic reflectivity and overlaying said pattern an image.

ADVANTAGEOUS EFFECT OF THE INVENTION

The invention provides improved security for security media. The invention includes an image and a base material with areas of specular and diffuse reflection in a pattern to form a customizable security feature.

DETAILED DESCRIPTION OF THE INVENTION

Figure 1:
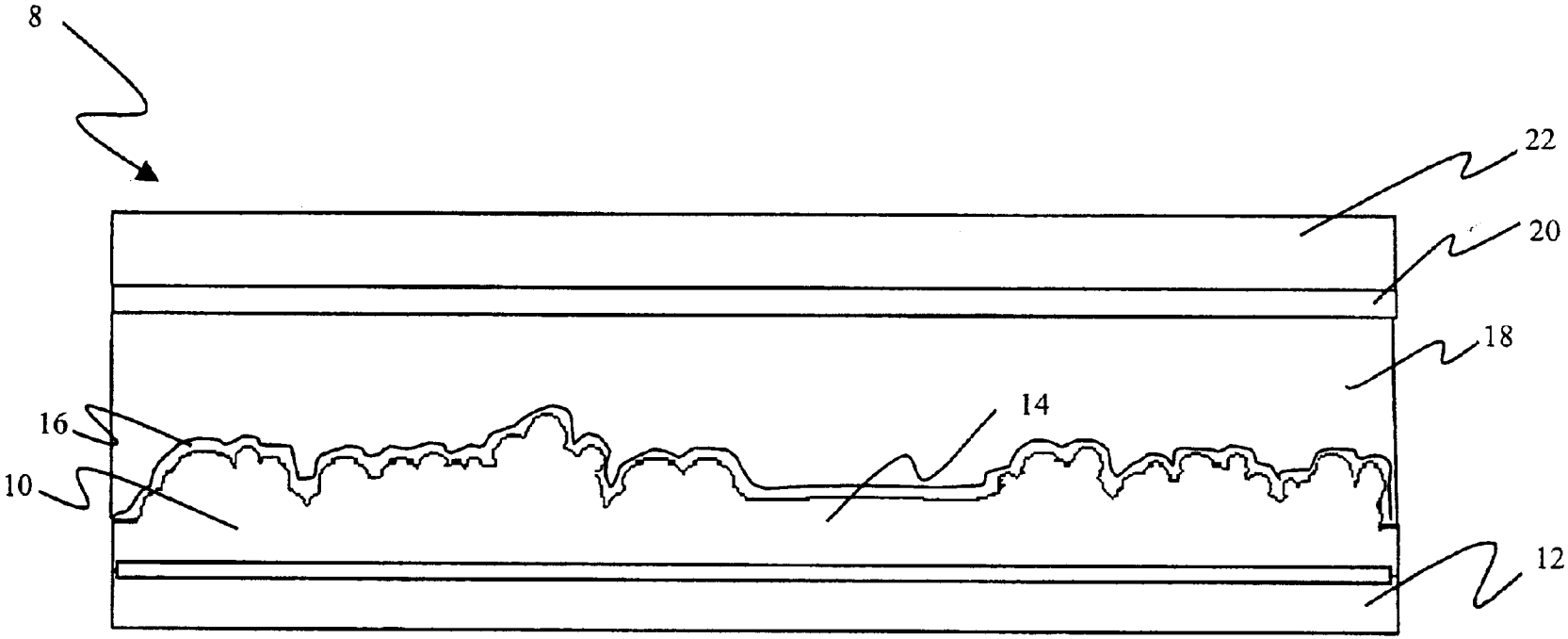
FIG. 1 illustrates a cross section of an image device formed by a base material with complex lens protuberances forming pattern of diffuse and specular metallic reflectivity and overlaying said pattern an image and a substrate.

The image device of this example has numerous advantages over prior art image devices for security purposes.

The image device prevents tampering better than some prior art image devices for security. Prior art devices, such as credit cards, use holograms that are adhered to the front of the devices. These holograms can be taken off and reapplied to other devices to make fake credit cards and IDs. Because the pattern of diffuse and specular reflectivity of the invention is very delicate and adhesively bonded to the image, the pattern of reflectivity is destroyed if it is tampered with or the card is opened. Furthermore, the device is very difficult to photocopy or to scan because the varying amounts of specular reflection will not copy.

The image device also is customizable where prior art security devices tend to be mass-produced. The prior art cards typically must then all have the same hologram, such as in a driver's license or a credit card. Because the image device of the invention's pattern of diffuse and specular reflectivity is printed, each security feature can be custom printed. This enables short runs of ID cards for smaller companies, or a greater level of security by, for example, adding the driver's name or birth date in specular reflectivity to each driver's license. Furthermore, the device is suitable for thermal printers which already have a large installation base in the ID card printing industry enabling the ability to print customized patterns of reflectivity for cards by changing the thermal donor and media.

The invention further provides polymer layers that serve as wear resistant surfaces on both sides of the image device so it will not be easily damaged during handling or use of the image as the image and pattern of reflectivity are below a layer of biaxially oriented polymer. The wear resistant surfaces of the invention provide protection from fingerprinting, spills of liquids, and other environmental deleterious exposures. Prior image devices do not have a wear resistant surface and therefore need an extra step of lamination typically on both sides of the device to provide protection. Lamination requires extra equipment, an extra step in the manufacturing process, and is time and money consuming. These and other advantages will be apparent from the detailed description below.

The term "diffuser" means any material that is able to diffuse specular light (light with a primary direction) to a diffuse light (light with random light direction). The term "light diffusion elements" means any element that is able to diffuse specular light (light with a primary direction) to a diffuse light (light with random light direction). The term "light" means visible light. The term "total light transmission" means percentage light transmitted through the sample at 500 nm as compared to the total amount of light at 500 nm of the light source. This includes both spectral and diffuse transmission of light. The term "diffusion efficiency" and "haze" means the ratio of % diffuse transmitted light at 500 nm to % total transmitted light at 500 nm multiplied by a factor of 100. "Transparent" means a film with total light transmission of 80% or greater at 500 nm. The term "light shaping efficiency" means the percent of light is shaped or directed compared to the amount of light that strikes the surface of the protuberance. "Diffuse reflection efficiency" is the % of light reflected diffusely (meaning that the incident and angle and reflected angle differ by more than 2.5 degrees) divided by the % total light reflected multiplied by 100. "Substantially transparent" means that the object or film transmits at least 70% of the light incident on it.

The term "light shaping element" means any structure that directs light as it passes through or reflects off of it. For example, a prism structure that collimates light or a metallic lens that directs or reflects light out in a random or specific direction are light shaping elements. The light directing can be at the micro or macro level. Diffuse and specular reflective areas of a film refer to the surface reflectivity characteristics of the side of the film that light is incident on. "Diffuse Reflective" means that light is reflected off the surface of the film diffusely. An example of a matte surface would be a plastic film with a roughened surface. "Specular reflection" means that light is reflected off of the surface of the film specularly. An example of a glossy surface would be a smooth plastic film. Roughness average means the average peak to valley measurement of the light shaping elements.

"Macro diffusion efficiency variation" means a diffusion efficiency variation that is greater than 5% between two locations that are separated by at least 2 cm. An optical gradient is a change in optical properties such as transmission, reflection, and light direction as a function of distance from a stating point. "Gradient", in reference to diffusion, means the gradual increasing or decreasing of diffusion efficiency relative to distance from a starting point.

The "specular area" of the image device is defined as where most of the light reflecting off the surface of the device is reflected specularly (not diffused). The diffuse reflection of light reflected off this area is typically less than 30%. The "diffuse area" of the image device is defined as where most of the light reflecting off the surface of the device is reflected diffusely. The diffuse reflection of light reflected off this area is typically more than 70%.

The term "polymeric film" means a film comprising polymers. The term "polymer" means homo- and co-polymers. The term "average", with respect to lens size and frequency, means the arithmetic mean over the entire film surface area. "In any direction", with respect to lenslet arrangement on a film, means any direction in the x and y plane. The term "pattern" means any predetermined arrangement whether regular or random. The term "microbead" means polymeric spheres typically synthesized using the limited coalescence process. The term "substantially circular" means indicates a geometrical shape where the major axis is no more than two times the minor axis.

In one embodiment of the invention, the diffusion film has a textured surface on at least one side, in the form of a plurality of random microlenses, or lenslets. The term "lenslet" means a small lens, but for the purposes of the present discussion, the terms lens and lenslet may be taken to be the same. The lenslets overlap to form complex lenses. "Complex lenses" means a major lens having on the surface thereof multiple minor lenses. "Major lenses" mean larger lenslets that the minor lenses are formed randomly on top of. "Minor lenses" mean lenses smaller than the major lenses that are formed on the major lenses. The term "concave" means curved like the surface of a sphere with the exterior surface of the sphere closest to the surface of the film. The term "convex" means curved like the surface of a sphere with the interior surface of the sphere closest to the surface of the film.

The surface of each lenslet is a locally spherical segment, which acts as a miniature lens to alter the ray path of energy passing through the lens. The shape of each lenslet is "semi-spherical" meaning that the surface of each lenslet is a sector of a sphere, but not necessarily a hemisphere. Its curved surface has a radius of curvature as measured relative to a first axis (x) parallel to the polymeric film and a radius of curvature relative to second axis (y) parallel to the polymeric film and orthogonal to the first axis (x). The lenses in an array film need not have equal dimensions in the x and y directions. The dimensions of the lenses, for example length in the x or y direction, are generally significantly smaller than a length or width of the film. "Height/Diameter ratio" means the ratio of the height of the complex lens to the diameter of the complex lens. "Diameter" means the largest dimension of the complex lenses in the x and y plane. The value of the height/diameter ratio is one of the main causes of the amount of light spreading, or diffusion that each complex lens creates. A small height/diameter ratio indicates that the diameter is much greater than the height of the lens creating a flatter, wider complex lens. A larger height/diameter value indicates a taller, thinner complex lens.

The divergence of light through the lens may be termed "asymmetric", which means that the divergence in the horizontal direction is different from the divergence in the vertical direction. The divergence curve is asymmetric, meaning that the direction of the peak light transmission is not along the direction $\theta=0°$, but is in a direction non-normal to the surface.

FIG. 1 illustrates a cross section of one embodiment of the image device 8 of the invention. On the base 12 are areas of complex lens protuberances 10 and the generally planar areas 14. A thin layer of metal 16 covers the complex lens protuberances 10 and the generally planar areas 14. An adhesive layer 18 over the metal layer 16 adheres the metal layer 16 to the image layer 20. A generally transparent substrate 22 overlays the image layer 20 to protect the image.

Figure 2:
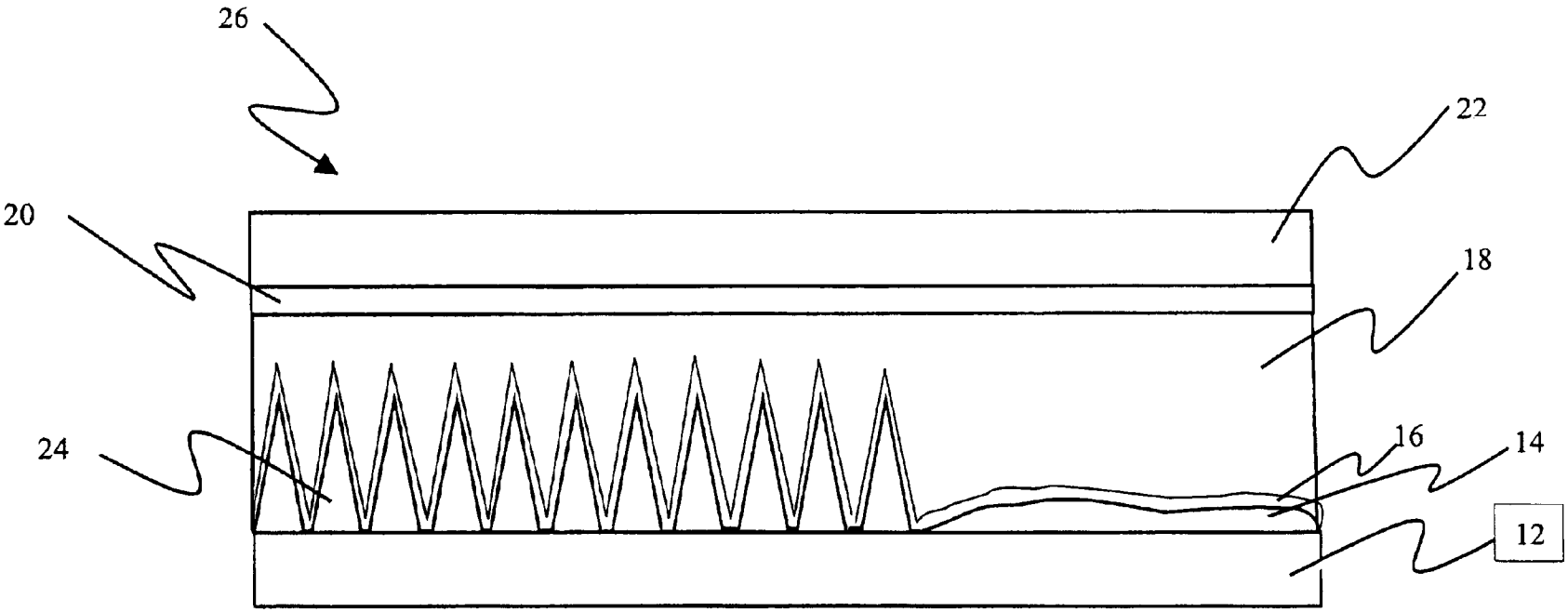
FIG. 2 illustrates a cross section of an image device formed by a base material with pyramidal shaped protuberances forming pattern of diffuse and specular metallic reflectivity and overlaying said pattern an image and a substrate.

FIG. 2 illustrates a cross section of another embodiment of the image device 28 of the invention. On the base 12 are areas of pyramidal shaped protuberances 24 and the generally planar areas 14. A thin layer of metal 16 covers the pyramidal shaped protuberances 24 and the generally planar areas 14. An adhesive layer 18 over the metal layer 16 adheres the metal layer 16 to the image layer 20. A substrate 22 overlays the image layer 20 to protect the image.

Preferably the base material comprises a substantially transparent polymer. The base provides dimensional stability to the pattern of diffuse and specular metallic reflectivity as stiffness and thickness to make it well suited to a system for printing and handling. It is preferable to be transparent so that the pattern of diffuse and specular metallic reflectivity can be easily seen. Most preferably, the base material has a light transmission of at least 85%. It has been shown that a substrate with at least 85% light transmission has an acceptable level of light transmission so that the reflectivity pattern can be easily viewed. It is important that the pattern of reflectivity be easily viewed so that authentication of the security media can be preformed easily and quickly.

Preferably the base material comprises a polymer. Polymers are easily processed, generally inexpensive, and can be manufactured roll to roll, tear resistant, and have excellent conformability, good chemical resistance and high in strength. Polymers are preferred, as they are strong and flexible. Preferred polymers include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers to improve mechanical or optical properties can be used. Preferred polyamides for the transparent complex lenses include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the complex lenses include cellulose nitrate, cellulose triacetate, cellulose diacetate, cellulose acetate propionate, cellulose acetate butyrate, and mixtures or copolymers thereof. Preferably, polyvinyl resins include polyvinyl chloride, poly(vinyl acetal), and mixtures thereof. Copolymers of vinyl resins can also be utilized. Preferred polyesters for the complex lens of the invention include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof.

The diffuse reflectivity areas preferably comprise metal-coated protuberances and the specular reflective areas comprise planar areas generally in the plane of the base. As light strikes the metal-coated protuberances it reflects off in many directions producing a diffuse reflection. It resembles a frosted mirror. The generally planar areas reflect light at approximately the same angle as the incident angle of the light. This produces a mirror like appearance. Having the protuberances and planar areas allows for the pattern of diffuse and specular metallic reflectivity.

The protuberances preferably have an average aspect ratio of 0.1 to 1.0. When the aspect ratio of the protuberances is less than 0.07, the amount of curvature is too low to sufficiently diffuse the light in reflection. This would cause the image device to be mostly specular and the difference between the melted protuberances (specular reflective areas) and the diffuse reflective (protuberance area) would be small. When the aspect ratio of the diffusion elements is greater than 2.0, it becomes difficult to fully flatten the protuberances and keep the metallic layer continuous as the protuberances were flattened creating breaks in the metallic layer.

Preferably, the protuberances comprise curved surfaces. Curved concave and convex polymer lenses have been shown to provide very efficient diffusing of reflected light, enabling a high contrast between the specular areas and diffuse areas. The lenses can vary in dimensions or frequency to control the amount of diffuse reflection. A high aspect ratio lens would diffuse the light more than a flatter, lower aspect ratio lens.

In another embodiment of the invention, the protuberances are preferably complex lenses. Complex lenses are lenses on top of other lenses. They have been shown to provide very efficient diffusion of light, enabling a high contrast between the specular areas and diffuse areas of reflection. The amount of diffusion is easily altered by changing the complexity, geometry, size, or frequency of the complex lenses.

The plurality of lenses of all different sizes and shapes are formed on top of one another to create a complex lens feature resembling a cauliflower. The lenslets and complex lenses formed by the lenslets can be concave into the transparent polymeric film or convex out of the plan of the film.

One embodiment of the present invention could be likened to the moon's cratered surface. Asteroids that hit the moon form craters apart from other craters, that overlap a piece of another crater, that form within another crater, or that engulf another crater. As more craters are carved, the surface of the moon becomes a complexity of depressions like the complexity of lenses formed in the light management film.

The complex lenses may differ in size, shape, off-set from optical axis, and focal length. The curvature, depth, size, spacing, materials of construction, and positioning of the lenslets determine the degree of diffusion, and these parameters are established during manufacture according to the invention.

The result of using a diffusion film having lenses whose optical axes are off-set from the center of the respective lens results in dispersing light from the film in an asymmetric manner. It will be appreciated, however, that the lens surface may be formed so that the optical axis is off-set from the center of the lens in both the x and y directions.

The lenslet structure can be manufactured on both sides of the film. The lenslet structures on either side of the support can vary in curvature, depth, size, spacing, and positioning of the lenslets. Both sides with protuberances are preferably coated with metal and can be printed independently of each other. This creates an extra level of security in that there are two sides of the security image device with different patterns of diffuse and specular reflection. There can be images adhered to one or both sides of the film to the pattern of reflectivity.

The concave or complex lenses on the surface of the polymer film are preferably randomly placed. Random placement of lenses increases the diffusion efficiency of the invention materials. Further, by avoiding a concave or convex placement of lenses that is ordered, undesirable optical interference patterns that could be distracting to the viewer are avoided.

Preferably, the concave or convex lenses have an average frequency in any direction of from 5 to 250 complex lenses/mm. When a film has an average of 285 complex lenses/mm, creates the width of the lenses approach the wavelength of light. The lenses will impart a color to the light reflecting off of the lenses and add unwanted color to the projected image. Having less than 4 lenses per millimeter creates lenses that are too large and therefore diffuse the light less efficiently. Concave or convex lenses with an average frequency in any direction of between 22 and 66 complex lenses/mm are more preferred. It has been shown that an average frequency of between 22 and 66 complex lenses provide efficient light diffusion and can be efficiently manufactured utilizing cast coated polymer against a randomly patterned roll.

The complex lenses have concave or convex lenses at an average width between 3 and 60 microns in the x and y direction. When lenses have sizes below 1 micron the lenses impart a color shift in the light reflecting because the lenses dimensions are on the order of the wavelength of light. When the lenses have an average width in the x or y direction of more than 68 microns, the lenses are large diffuse the light less efficiently. More preferred, the concave or convex lenses at an average width between 15 and 40 microns in the x and y direction. This size lenses has been shown to create the most efficient diffusion.

The concave or convex complex lenses comprising minor lenses wherein the width in the x and y direction of the smaller lenses is preferably between 2 and 20 microns. When minor lenses have sizes below 1 micron the lenses impart a color shift in the light reflecting because the lenses dimensions are on the order of the wavelength of light and add unwanted color to the projected image. When the minor lenses have sizes above 25 microns, the diffusion efficiency is decreased because the complexity of the lenses is reduced. More preferred are the minor lenses having a width in the x and y direction between 3 and 8 microns. This range has been shown to create the most efficient diffusion.

The number of minor lenses per major lens is preferably from 2 to 60. When a major lens has one or no minor lenses, its complexity is reduced and therefore it does not diffuse as efficiently. When a major lens has more than 70 minor lens contained on it, the width of some of the minor lens approaches the wavelength of light and imparts a color to the light reflected. Most preferred are from 5 to 18 minor lenses per major lens. This range has been shown to produce the most efficient diffusion.

Preferably, the concave or convex lenses are semi-spherical meaning that the surface of each lenslet is a sector of a sphere, but not necessarily a hemisphere. This provides excellent even diffusion over the x-y plane. The semi-spherical shaped lenses scatter the incident light uniformly.

The protuberances comprising surface microstructures are preferred. A surface microstructure is easily altered in design of the surface structures and altered in with heat and/or pressure to achieve patterns of diffuse and specular reflection. Microstructures can be tuned for different light shaping and spreading efficiencies and how much they spread light. Examples of microstructures are a simple or complex lenses, prisms, pyramids, and cubes. The shape, geometry, and size of the microstructures can be changed to accomplish the desired light shaping.

The surface microstructure can comprise any surface structure, whether ordered or random. The microstructure can be a linear array of prisms with pointed, blunted, or rounded tops or sections of a sphere, prisms, pyramids, and cubes. The optical elements can be random or ordered, and independent or overlapping. The sides can be sloped, curved, or straight or any combination of the three. The protuberances can also be retroreflective structures, typically used for road and construction signs or a Fresnel lens designed to collimate light.

The pattern of diffuse and specular metallic reflectivity comprises diffuse reflection efficiency differs by an amount greater than 20% from the diffuse to specular areas. A reflection efficiency that varies less than 15 percent would not be easily readable and therefore difficult to determine authenticity. Most preferred is a diffuse reflection efficiency that varies more than 60 percent from the specular to diffuse metallic reflective areas. It has been shown that over 60 percent variation in diffuse reflection efficiency of the image device produces a device that has an easily readable security feature. Furthermore, the greater the difference in diffuse reflection between the diffuse and specular areas, the more difficult it is to counterfeit.

A diffuse reflector wherein the reflection efficiency variation comprises a gradient is preferred. Have a gradient allows for the smooth transition from one reflection efficiency to another reflection efficiency. For example, it would be useful to have a gradient because it is difficult to counterfeit and the pattern of reflectivity could form interesting images, text, and patterns with gradients instead of sharp changes in reflectivity. A gradient allows the reflection transition to be undetectable by the viewer. The reflection efficiency can change by the following mathematical variations, for example:

Reflection efficiency=$e^{1/distance}$ or $e^{-1/distance}$

Reflection efficiency=1/distance or −1/distance

Reflection efficiency=distance*x or −distance*x (where x is a real number)

Preferably, the protuberances comprise a polyolefin. Polyolefins are low in cost and high in light transmission. Further, polyolefin polymers are efficiently melt extrudable and therefore can be used to create image device in roll form. Furthermore, most polyolefins have a low Tg (below 75° C.) allowing for the easy change of surface reflectivity by melting the surface diffuse metallic reflective areas. Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful.

When the protuberances have a glass transition temperature of over 82 degrees Celsius it takes more time and energy to melt the protuberances to create planar areas. If the high heat and exposure time is not applied to the protuberances, (which increases the printing cost of the media significantly), and then the protuberances will not fully melt and will retain some of the diffusion characteristics of the original surface roughness. This lowers the difference between the diffuse reflectivity of the diffuse and specular areas because the printed semi-glossy areas still diffusely reflect some of the light. This creates patterns of reflectivity are difficult to read.

Having the polymer layer with a glass transition temperature of less than 55 degrees Celsius is preferred. It has been shown that when the polymer layer has a Tg of less than 55° C. very efficient melting of the protubreances occurs when heat and/or pressure is applied. Furthermore, the dye or other colorant transfers well from the donor to the image device using polymers with glass transition temperatures below 55° C.

Preferably, the metallic reflectivity is from a metal. Metals, for example aluminum, copper, silver, platinum, gold, and brass, are preferred because of their high reflectivity in relatively thin layers. In another embodiment, the metallic reflectivity is from an alloy. Using an alloy is preferred because the reflectance and mechanical properties can be tailored by using two or more metals with different properties. Most preferably, the metallic reflectivity is from silver or aluminum. Silver and aluminum can be easily vacuum coated onto moving webs and have high reflectivity for thin films.

Preferably, the metal thickness is between 10 and 5,000 angstroms. A layer with thickness less than 7 angstroms tends to be very translucent and therefore the pattern of diffuse and specular reflectivity is difficult to see and read. A reflective layer thickness of over 5,080 angstroms does not give an added amount of total reflectivity and uses more materials. Furthermore, when melting the protuberances covered in metal, when the metallic layer is very thick (thicker than 5,080 angstroms) it becomes more difficult to apply heat and pressure to melt the protuberances resulting in a pattern of diffuse and specular reflectivity that is not fully formed. Most preferred, the metal has a thickness of 500 to 1,000 angstroms. It has been shown that this range can deliver the desired reflectivity properties while minimizing material and manufacturing costs.

Since the thermoplastic light reflector of the invention typically is used in combination with other optical web materials, an image device with an elastic modulus greater than 500 MPa is preferred. An elastic modulus greater than 500 MPa allows for the image device to be laminated with a pressure sensitive, heat activated, or other type of adhesive for combination with other webs materials or imaging elements.

An image device where the base with areas of diffuse and specular reflectivity has a scratch sensitivity of less than 0.1 Gpa is preferred. When the image device is assembled, the pattern of diffuse and specular reflectivity is protected by the overlaying image. Because the metallic reflectivity area is very scratch prone, it reduces the ability for forgery. If the image device to is be taken apart to insert another image, the metallic reflectivity layer will tear and destroy itself. Having a low scratch sensitivity helps insure that the image device can not be tampered with.

The areas of specular reflectivity are preferably further provided with a colored layer. The colored layer preferably comprises dye or pigment because they have excellent color reproduction and color stability. Dyes and pigments are able to create a large color gamut and saturation. Furthermore, they are easily incorporated into extrusions and coatings. Nano-sized pigments can also be used, with the advantage that less of the pigment is needed to achieve the same color saturation because the pigment particles surface area to volume ratios are so large they are more efficient at adding color. The colored layer is preferably added to the areas of specular reflectivity using dyes that sublimate and thermal printing. This is advantaged because there are no registration issues between the areas of color (dye sublimation) and the specular reflectivity because they are created at the same time using a printing technique that is inexpensive and already supported by the printing industry. Multiple colors can be added to each sheet enabling an interesting and appealing material that has functionality.

The imaging device preferably comprises areas of specular reflectivity that form graphics, text, or images. Preferably, the imaging device creates patterns, text, and pictures of selectively by selectively changing the surface reflectivity. This enables the creation of visually interesting and easily viewed media for advertising, labels, ID cards. The specular reflectivity areas can form text to embed text into security features such as a name or company. For example, a driving license could have the driver's birth date in specular reflection in the card making it very difficult to alter the birth date of the driver. The areas of specular reflectivity provide an image. This image could incorporate different levels of specular and diffuse reflectivity as well as gradients. This would provide a secure image security device where it would be very difficult to counterfeit the card.

Preferably, the specular reflective areas comprise graphics or indicia to create a unique and less obtrusive way to brand items. The indicia could be a watermark on a security document. Preferably, the indicia comprise a security feature. One example of a security system would be information or barcodes imbedded into a package or substrate with the difference in diffuse and specular reflectivity is less than 5%. This would make it very difficult to people to see and difficult to copy, but a machine could detect the difference and hinder counterfeiters. The diffuse and specular metallic reflectivity also can not be accurately photocopied making forgery more difficult. The reflection media can be used in the same applications as a hologram for security purposes.

Preferably, the indicia comprise a barcode. The barcode would use differences in surface reflectivity rather than adsorption (as in current barcode systems) to store information. One system to read a reflection media barcode would be a collimated source such as a laser. Part of the laser's light and energy would reflect of the surface of the reflection media. In the specular reflection areas, the light reflected would be approximately equal to the angle of the incident light. A detector would collect the reflected light. In the diffuse reflection areas, the incident light from the collimated light source would be scattered and the detector would only measure a small portion of light. This difference in the amount of light reflected back and measured would be read by the detector as a unique barcode that would translate into a price or a description of the item scanned.

The reflective area preferably further comprises fluorescent or phosphorescent materials in the areas of specular reflectivity. These materials will "glow" when exposed to light. They can be used as an added security feature to the imaging device and because they are only in the areas of specular reflectivity, the "glowing" areas can form text, images, and graphics in registration with the specular reflectivity. This could be used, for example, on a driver's license as an easy way for a police officer to detect if a driver's license is authentic in the dark by shining their flashlight onto the license to see if it has a fluorescent or phosphorescent pattern on it. A typical fluorescent material is BLANCOPHOR SOL from Bayer/USA.

Phosphorescent materials comprise phosphorescent pigments which are available in various colors including blue, green, yellow, orange, and red. The most common phosphorescent pigment is yellowish-green, which is brightest to the human eye, and has a wave length of about 530 nanometers. This pigment is composed of a copper-doped zinc sulfide. A phosphorescent pigment can remain visible in the dark for up to four hours and longer, depending on the source and intensity of excitation energy, the dark adaptation of the eyes, ambient light, and area of and distance from the phosphorescence, as well as other factors. A high ultraviolet (UV) source of energy is considered most effective as an excitation source, although virtually any light is effective at stimulating phosphorescence at some level.

In providing a fluorescent or phosphorescent pigment in a form in which it can be coated or onto a substrate, the pigments are dispersed in a binding medium that must be substantially transparent and, in fact, should be of a high transparency. The particular binding medium can be selected by the skilled artisan depending on the material to be coated or in which the phosphorescent material is to be blended. Zinc Sulfide and Strontium Aluminate are two common phosphorescent materials.

Preferably, the image device is provided with conductive leads from the areas of specular reflectivity to an exposed surface. This enables a way to detect whether the image device is authentic. The image device may have a customizable circuit created by the specular reflectivity. The conductive leads connect the specular reflectivity areas with an exposed surface so that the conductivity can be easily measured. Creating a customizable circuit (in both appearance and resistively) makes the image device more difficult to counterfeit or tamper with.

Preferably, the areas of specular reflectivity have a resistively of between 50 and 2500 ohms per square. This range allows for the easy measurement of the conductivity if the specular reflection areas. When the resistively of the specular reflectivity areas is greater than 2650 ohms per square, the resistively of the specular reflectivity areas approaches the resistively of the rest of the card. This leads to a low signal to noise ratio and is difficult to read. A very high voltage would be needed to have a better signal to noise ratio and that would be expensive and dangerous. A resistively of less than 40 ohms per square is expensive to manufacture. 50 to 2500 ohms per square resistively allows for a high signal to noise ratio for accurate and easy measurement.

The overlaying of the pattern of diffuse and specular metallic reflectivity is preferably accomplished by adhering a substrate with an image to the pattern. The substrate with the image is adhered to the pattern to protect the pattern (which can be easily scratched) and to embed the pattern to make counterfeiting and tampering with the patterned layer more difficult. The image can provide additional information and content. The image on the substrate may be adhered to the pattern by any adhering method including pressure sensitive adhesive, heat activated adhesive, or UV cured adhesive. The adhesive preferably is coated or applied to the substrate. The preferred adhesive materials may be applied using a variety of methods known in the art to produce thin, consistent adhesive coatings. Examples include gravure coating, rod coating, reverse roll coating and hopper coating.

Preferably, the image is adhered to the base with the pattern of diffuse and specular reflectivity such that the image is in registration with the pattern of diffuse and specular reflection. This can be accomplished by printing the media with a thermal printer. Because a thermal printer uses heat and pressure to transfer the dye, at the same time that the dye is being transferred the metal-coated protuberances can be melted creating the pattern of diffuse and specular metallic reflectivity. When the image is in registration with the pattern of reflectivity, it is more difficult to counterfeit.

The substrate that the image is on is preferably a substantially transparent polymer sheet. Polymers are easily processed, generally inexpensive, and can be manufactured roll to roll, tear resistant, and have excellent conformability, good chemical resistance and high in strength. The polymer sheet is preferably transparent so that the pattern of diffuse and specular metallic reflectivity can be seen through it. Most preferably, the substrate has a light transmission of at least 85%. It has been shown that a substrate with at least 85% enough detail of the pattern of reflectivity can be through the substrate for the diffuse and specular reflective areas to be easily viewed. Furthermore, if the substrate is the outermost film on the image device, the image can be seen clearly also. Preferred polymer substrates include polyester, oriented polyolefin such as polyethylene and polypropylene, cast polyolefins such as polypropylene and polyethylene, polystyrene, acetate and vinyl.

In an embodiment of the invention, the substantially transparent polymer sheet is on the outside of the image device. The polymer sheet is substantially transparent so that the image on the other side of it can be seen through the polymer sheet. This polymer sheet also protects the image from scratching and abrasions. The image device preferably has a hard coat on the outside surface of the device.

The base and substrate are adhesively connected. Preferably, the pattern of diffuse and specular metallic reflectivity is in contact with the adhesive. This orientation is preferred because if the image device were to be tampered with the break in the adhesive would destroy the reflectivity layer because it is very fragile. Furthermore, having the diffuse and specular reflectivity layer in contact with the adhesive leaves the base on the outside of the image device providing protection for the reflectivity layer. Preferably, the image is in contact with the adhesive leaving the substrate to be on the outside of the image device protecting the image. Most preferred would be the following stack:

| |
|---|
| Substrate |
| Image |
| Adhesive |
| Pattern of diffuse and reflective metallic reflectivity |
| Base |

In this embodiment, polymer films protect both the pattern of diffuse and specular metallic reflectivity and the image. Preferably, both the base and the substrate are substantially transparent so that the image and the pattern of reflectivity can be seen from one side of the image device and the pattern of reflectivity can be seen from the back. In another embodiment, there is another image or information layer applied to base on the opposite side to the pattern of reflectivity. This enables a two-sided image device with the pattern of reflectivity sandwiched between the two images.

Preferably, the overlaying image is created by having a thermal image on a substantially transparent polymer substrate, where the image is adhesively attached to the diffuse and specular areas such that the base material and the substrate form the outer surfaces of the image device. This orientation of the image device provides protection for both the image and the pattern of diffuse and specular reflection. Furthermore, if the image device were to be tampered with, when the image and the pattern of reflectivity separated, there would be damage to the pattern of reflectivity and most likely the image as well. Either the base or the substrate can be transparent or both can be transparent. Therefore, one or both sides of the pattern of reflectivity can be seen.

Used herein, the phrase 'imaging element' comprises an imaging support, along with an image receiving layer as applicable to multiple techniques governing the transfer of an image onto the imaging element. Such techniques include thermal dye transfer, electrophotographic printing, or ink jet printing, as well as a support for photographic silver halide images. As used herein, the phrase "photographic element" is a material that utilizes photosensitive silver halide in the formation of images.

Preferably, the image is formed by a thermal printer. Thermal printing produces good image quality and is already in place in the security card industry. Furthermore, because the dyes are transferred using heat and pressure, at the same time as the dyes are being transferred the metal-coated protuberances can be flatted to create the pattern of diffuse and specular metallic reflectivity.

The thermal dye image-receiving layer of the receiving elements of the invention may comprise polymers or mixtures of polymers that provide sufficient dye density, printing efficiency and high quality images. For example, polycarbonate, polyurethane, polyester, polyvinyl chloride, poly(styrene-co-acrylonitrile), poly(caprolactone), polylatic acid, saturated polyester resins, polyacrylate resins, poly (vinyl chloride-co-vinylidene chloride), chlorinated polypropylene, poly(vinyl chloride-co-vinyl acetate), poly (vinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, maleic acid resins, vinyl polymers, such as polystyrene and polyvinyltoluene or copolymer of vinyl polymers with methacrylates or acrylates, poly(tetrafluoroethylene-hexafluoropropylene), low-molecular weight polyethylene, phenol-modified pentaerythritol esters, poly(styrene-co-indene-co-acrylonitrile), poly(styrene-co-indene), poly(styrene-co-acrylonitrile), poly(styrene-co-butadiene), poly(stearyl methacrylate) blended with poly(methyl methacrylate). Among them, a mixture of a polyester resin and a vinyl chloridevinyl acetate copolymer is preferred, with the mixing ratio of the polyester resin and the vinyl chloride-vinyl acetate copolymer being preferably 50 to 200 parts by weight per 100 parts by weight of the polyester resin. By use of a mixture of a polyester resin and a vinyl chloride-vinyl acetate copolymer, light resistance of the image formed by transfer on the image-receiving layer can be improved.

The dye image-receiving layer may be present in any amount that is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et al.

In another embodiment of the invention, the thermal dye receiving layer comprises a polyester. Polyesters are low in cost and have good strength and surface properties. Polyesters have high optical transmission values that allow for high light transmission and diffusion. This high light transmission and diffusion allows for greater differences in the bright and dark projected areas increasing contrast. In a preferred embodiment of the invention, the polyesters have a number molecular weight of from about 5,000 to about 250,000 more preferably from 10,000 to 100,000.

The polymers used in the dye-receiving elements of the invention are condensation type polyesters based upon recurring units derived from alicyclic dibasic acids (Q) and diols (L) wherein (Q) represents one or more alicyclic ring containing dicarboxylic acid units with each carboxyl group within two carbon atoms of (preferably immediately adjacent) the alicyclic ring and (L) represents one or more diol units each containing at least one aromatic ring not immediately adjacent to (preferably from 1 to about 4 carbon atoms away from) each hydroxyl group or an alicyclic ring which may be adjacent to the hydroxyl groups. For the purposes of this invention, the terms "dibasic acid derived units" and "dicarboxylic acid derived units" are intended to define units derived not only from carboxylic acids themselves, but also from equivalents thereof such as acid chlorides, acid anhydrides and esters, as in each case the same recurring units are obtained in the resulting polymer. Each alicyclic ring of the corresponding dibasic acids may also be optionally substituted, e.g. with one or more C1 to C4 alkyl groups. Each of the diols may also optionally be substituted on the aromatic or alicyclic ring, e.g. by C1 to C6 alkyl, alkoxy, or halogen.

In another embodiment of the invention, the polymer layer comprises a polycarbonate. The diffusion elements formed out of polycarbonate are easily melted to form areas of specular and diffuse transmission. Polycarbonates have high optical transmission values that allow for high light transmission and diffusion. This high light transmission and diffusion allows for greater differences in the bright and dark projected areas increasing contrast.

Polycarbonates (the term "polycarbonate" as used herein means a carbonic acid and a diol or diphenol) and polyesters have been suggested for use in image-receiving layers. Polycarbonates (such as those disclosed in U.S. Pat. Nos. 4,740,497 and 4,927,803) have been found to possess good dye uptake properties and desirable low fade properties when used for thermal dye transfer. As set forth in U.S. Pat. No. 4,695,286, bisphenol-A polycarbonates of number average molecular weights of at least about 25,000 have been found to be especially desirable in that they also minimize surface deformation that may occur during thermal printing.

Polyesters, on the other hand, can be readily synthesized and processed by melt condensation using no solvents and relatively innocuous chemical starting materials. Polyesters formed from aromatic diesters (such as disclosed in U.S. Pat. No. 4,897,377) generally have good dye up-take properties when used for thermal dye transfer. Polyesters formed from alicyclic diesters disclosed in U.S. Pat. No. 5,387,571 (Daly et al.) and polyester and polycarbonate blends disclosed in U.S. Pat. No. 5,302,574 (Lawrence et al.), the disclosure of which is incorporated by reference.

Polymers may be blended for use in the dye-receiving layer in order to obtain the advantages of the individual polymers and optimize the combined effects. For example, relatively inexpensive unmodified bisphenol-A polycarbonates of the type described in U.S. Pat. No. 4,695,286 may be blended with the modified polycarbonates of the type described in U.S. Pat. No. 4,927,803 in order to obtain a receiving layer of intermediate cost having both improved resistance to surface deformation which may occur during thermal printing and to light fading which may occur after printing. A problem with such polymer blends, however, results if the polymers are not completely miscible with each other, as such blends may exhibit a certain amount of haze. While haze is generally undesirable, it is especially detrimental for transparent labels. Blends that are not completely compatible may also result in variable dye uptake, poorer image stability, and variable sticking to dye donors.

In a preferred embodiment of the invention, the alicyclic rings of the dicarboxylic acid derived units and diol derived units contain from 4 to 10 ring carbon atoms. In a particularly preferred embodiment, the alicyclic rings contain 6 ring carbon atoms.

A dye-receiving element for thermal dye transfer comprising a miscible blend of an unmodified bisphenol-A polycarbonate having a number molecular weight of at least about 25,000 and a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring are preferred. This polymer blend has excellent dye uptake and image dye stability, and which is essentially free from haze. It provides a receiver having improved fingerprint resistance and retransfer resistance, and can be effectively printed in a thermal printer with significantly reduced thermal head pressures and printing line times. Surprisingly, these alicyclic polyesters were found to be compatible with high molecular weight polycarbonates.

Examples of unmodified bisphenol-A polycarbonates having a number molecular weight of at least about 25,000 include those disclosed in U.S. Pat. No. 4,695,286. Specific examples include Makrolon 5700 (Bayer AG) and LEXAN 141 (General Electric Co.) polycarbonates.

In a further preferred embodiment of the invention, the unmodified bisphenol-A polycarbonate and the polyester polymers are blended at a weight ratio to produce the desired Tg of the final blend and to minimize cost. Conveniently, the polycarbonate and polyester polymers may be blended at a weight ratio of from about 75:25 to 25:75, more preferably from about 60:40 to about 40:60.

Among the necessary features of the polyesters for the dye receiving blends utilized in the invention is that they do not contain an aromatic diester such as terephthalate, and that they be compatible with the polycarbonate at the composition mixtures of interest. The polyester preferably has a Tg of from about 40 C to about 100 C, and the polycarbonate a Tg of from about 100 C to about 200 C. The polyester preferably has a lower Tg than the polycarbonate, and acts as a polymeric plasticizer for the polycarbonate. The Tg of the final polyester/polycarbonate blend is preferably between 40 C and 100 C. Higher Tg polyester and polycarbonate polymers may be useful with added plasticizer. Preferably, lubricants and/or surfactants are added to the dye receiving layer for easier processing and printing. The lubricants can help in polymer extrusion, casting roll release, and printability. Preferably, the polyester dye receiving layer is melt extruded on the outer most surface of the upper polymer sheet.

Dye-donor elements that are used with the dye-receiving element of the invention conventionally comprise a support having thereon a dye containing layer. Any dye can be used in the dye-donor employed in the invention, provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228. As noted above, dye-donor elements are used to form a dye transfer image. Such a process comprises image-wise-heating a dye-donor element and transferring a dye image to a dye-receiving element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three-color dye transfer image. When the process is only performed for a single color, then a monochrome dye transfer image is obtained.

Thermal printing heads, which can be used to transfer dye from dye-donor elements to receiving elements of the invention, are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form, the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an-electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the particle. Heating both removes residual liquid and fixes the toner to paper.

When used as ink jet imaging media, the recording elements or media typically comprise a substrate or a support material having on at least one surface thereof an ink-receiving or image-forming layer. If desired, in order to improve the adhesion of the ink receiving layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, can be applied to the surface of the support. The ink receiving layer is preferably coated onto the support layer from water or water-alcohol solutions at a dry thickness ranging from 3 to 75 micrometers, preferably 8 to 50 micrometers.

Any known ink jet receiver layer can be used in combination with the external polyester-based barrier layer preferably utilized present invention. For example, the ink receiving layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, and the like; derivatives of natural polymers such as functionalized proteins, functionalized gums and starches, and cellulose ethers and their derivatives; and synthetic polymers such as polyvinyloxazoline, polyvinylmethyloxazoline, polyoxides, polyethers, poly(ethylene imine), poly(acrylic acid), poly(methacrylic acid), n-vinyl amides including polyacrylamide and polyvinylpyrrolidone, and poly(vinyl alcohol), its derivatives and copolymers; and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of non-solvent. In general, it is preferred for the base layer to be hydrophilic, but not porous. This is especially true for photographic quality prints, in which porosity may cause a loss in gloss. In particular, the ink receiving layer may consist of any hydrophilic polymer or combination of polymers with or without additives as is well known in the art.

If desired, the ink receiving layer can be overcoated with an ink-permeable, anti-tack protective layer, such as, for example, a layer comprising a cellulose derivative or a cationically-modified cellulose derivative or mixtures thereof. The overcoat layer is non porous, but is ink permeable and serves to improve the optical density of the images printed on the element with water-based inks. The overcoat layer can also protect the ink receiving layer from abrasion, smudging, and water damage. In general, this overcoat layer may be present at a dry thickness of about 0.1 to about 5 micrometers, preferably about 0.25 to about 3 micrometers.

In practice, various additives may be employed in the ink receiving layer and overcoat. These additives include surface active agents such as surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The layers described above, including the ink receiving layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating, and the like. Some of these methods allow for simultaneous coatings of both layers, which is preferred from a manufacturing economic perspective.

The DRL (dye receiving layer) is coated over the tie layer or TL at a thickness ranging from 0.1–10 micrometers, preferably 0.5–5 micrometers. There are many known formulations which may be useful as dye receiving layers. The primary requirement is that the DRL is compatible with the inks with which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al in U.S. Pat. Nos. 4,879,166; 5,264,275; 5,104,730; 4,879,166, and Japanese Patents 1,095,091; 2,276,671; 2,276,670; 4,267,180; 5,024,335; and 5,016,517 disclose aqueous based DRL formulations comprising mixtures of psuedo-bohemite and certain water soluble resins. Light in U.S. Pat. Nos. 4,903,040; 4,930,041; 5,084,338; 5,126,194; 5,126,195; and 5,147,717 disclose aqueous-based DRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable DRL formulations based on poly(vinyl alcohol). Iqbal in U.S. Pat. No. 5,208,092 discloses water-based IRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is 0.1–10 micrometers thick and is coated as an aqueous dispersion of 5 parts alumoxane and 5 parts poly(vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

The photographic element of this invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100 micro-seconds duration in a pixel-by-pixel mode wherein the silver halide emulsion layer is comprised of silver halide grains is also suitable. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above. This invention in a preferred embodiment utilizes a radiation-sensitive emulsion comprised of silver halide grains (a) containing greater than 50 mole percent chloride based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula:

$$[ML_6]^n \quad \text{(I)}$$

wherein n is zero, −1, −2, −3, or −4; M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand; and (ii) an iridium coordination complex containing a thiazole or substituted thiazole ligand. Preferred photographic imaging layer structures are described in EP Publication 1 048 977. The photosensitive imaging layers described therein provide particularly desirable images on the base of this invention.

The metal-coated protuberances (ex. lenses on the complex lens diffuser, surface texture on a surface diffuser) can be altered using heat and/or pressure. The process consists of using heat and/or pressure in a gradient or pattern to produce a pattern of diffuse and specular metallic reflectivity. When heat and/or pressure is applied to the protuberances, the protuberance partially or fully melts, flows, and cools to form a new structure where most or all of the protuberance is flattened. In the case of the protubreances being complex lenses, heat and/or pressure will melt the lenses (which are preferably made up of thermoplastic) and will reform to create newly shaped lenses that are shallower than the original lenses or a substantially smooth polymer surface. Heat and/or pressure is a way to selectively turn parts diffuse reflective areas into partially diffuse or specular areas of the image device and can be applied in a very precise way to create dots, lines, patterns, and text.

Preferably, a resistive thermal head applies the heat and/or pressure. The resistive thermal head, such as a print head found in a thermal printer, uses heat and pressure to melt the protuberances to create areas of specular transmission. As the printer prints, the printer head heats the polymer sheet and supplies pressure to deform or completely melt the protuberances. This process is preferred because it has accurate resolution, can add color at the same time as melting the lenses, and uses heats and pressures to melt a range of polymers. The resolution of the pattern of diffuse and specular reflection depends on the resolution of the print head. Preferably, color is added to the areas of specular reflection. This makes the image device more difficult for counterfeit. The color added is preferably a dye because dyes are transparent so the colored areas show up bright and colored. Furthermore, dyes are easily added at the same time the specular areas are created using dyes that sublimate and a thermal printer. This is advantaged because there are no registration issues between the areas of color (with dye) and the areas of specular reflection because they are created at the same time using a printing technique that is inexpensive and already supported by the printing industry.

Additional layers preferably are added to the light management film that may achieve added utility. Such layers might contain tints, antistatic materials, or an optical brightener. An optical brightener is substantially colorless, fluorescent, organic compound that absorbs ultraviolet light and emits it as visible blue light. Examples include but are not limited to derivatives of 4,4'-diaminostilbene-2,2'-disulfonic acid, coumarin derivatives such as 4-methyl-7-diethylaminocoumarin, 1-4-Bis (O-Cyanostyryl)Benzol and 2-Amino-4-Methyl Phenol. Optical brightener can be used in a skin layer leading to more efficient use of the optical brightener.

The image device or parts of the image device may be coated or treated with any number of coatings which may be used to improve the properties of the sheets including printability, to provide a vapor barrier, to make them heat sealable, or to improve adhesion. Examples of this would be acrylic coatings for printability, coating polyvinylidene chloride for heat seal properties. Further examples include flame, plasma or corona discharge treatment to improve printability or adhesion. The image device of the present invention may be used in combination with a film or sheet made of a transparent polymer. Examples of such polymer are polyesters such as polycarbonate, polyethylene terephthalate, polybutylene terephthalate and polyethylene naphthalate, acrylic polymers such as polymethyl methacrylate, and polyethylene, polypropylene, polystyrene, polyvinyl chloride, polyether sulfone, polysulfone, polyarylate and triacetyl cellulose.

The image device of the invention may also be used in conjunction with a light diffuser, for example a bulk diffuser, a lenticular layer, a beaded layer, a surface diffuser, a holographic diffuser, a micro-structured diffuser, another lens array, or various combinations thereof. The lenslet diffuser film disperses, or diffuses, the light, thus destroying any diffraction pattern that may arise from the addition of an ordered periodic lens array. The image device may also be used in an application with more than one sheet of the light management film stacked, or with any other optical film including brightness enhancement films, retroreflective films, waveguides, and diffusers.

It is preferred to use the process of extrusion polymer coating to create the protuberances on the base. It is known to produce polymeric film having a resin coated on one surface thereof with the resin having a surface texture. This kind of transparent polymeric film is made by an extrusion polymer coating process in which raw (uncoated) polymeric film is coated with a molten resin, such as polyethylene. The polymeric film with the molten resin thereon is brought into contact with a chill roller having a surface pattern. Chilled water is pumped through the roller to extract heat from the resin, causing it to solidify and adhere to the polymeric film. During this process the surface texture on the chill roller's surface is imprinted into the resin coated polymeric film. Thus, the surface pattern on the chill roller is critical to the surface produced in the resin on the coated transparent polymeric film. Similarly, these polymers may be extruded simultaneously with other polymer melts in a process of coextrusion. The layers coextruded with these polymers could be the backing, support, intermediate layers, or overcoat for the dye receiver layer. In the simplest case, the polymers of this invention may be extruded thick enough to serve as both support and receiver layer to yield a single step manufacturing process. Extrusion and coextrusion techniques are well known in the art and are described, e.g., in Encyclopedia of Polymer Science and Engineering, Vol. 3, John Wiley, New York, 1985, p. 563, and Encyclopedia of Polymer Science and Engineering, Vol. 6, john Wiley, New York, 1986, p. 608, the disclosures of which are incorporated by reference.

A method of fabricating the protubernaces was developed. The preferred approach comprises the steps of providing a positive master chill roll having the inverse of the desired surface morphology. The protuberances are replicated from the master chill roller by casting a molten polymeric material to the face of the chill roll and transferring the polymeric material with lenslet structures onto a polymeric film creating the desired morphology on the film.

A chill roller is manufactured by one of many processes to achieve the desired surface topography. Laser ablation or etching, photolithography, thin dense chrome, and diamond cutting are just a few of the processes. One process includes the steps of electroplating a layer of cooper onto the surface of a roller, and then abrasively blasting the surface of the copper layer with beads, such as glass or silicon dioxide, to create a surface texture with hemispherical features. The resulting blasted surface is bright nickel electroplated or chromed to a depth that results in a surface texture with the features either concave into the roll or convex out of the roll. Because of the release characteristics of the chill roll surface, the resin will not adhere to the surface of the roller.

The bead blasting operation (to create lenses or complex lens surface geometry) is carried out using an automated direct pressure system in which the nozzle feed rate, nozzle distance from the roller surface, the roller rotation rate during the blasting operation and the velocity of the particles are accurately controlled to create the desired lenslet structure. The number of features in the chill roll per area is determined by the bead size and the pattern depth. Larger bead diameters and deeper patterns result in fewer numbers of features in a given area. Therefore the number of features is inherently determined by the bead size and the pattern depth. This process creates protuberances that are curved features and can create complex lenses.

The protuberances can be formed using the process of solvent coating. The coating can be applied to one or both substrate surfaces through conventional pre-metered or post-metered solvent coating methods such as blade, air knife, rod, and roll coating. The choice of coating process would be determined from the economics of the operation and in turn, would determine the formulation specifications such as coating solids, viscosity, and speed. The coating processes can be carried out on a continuously operating machine wherein a single layer or a plurality of layers is applied to the support. Solvent coating is preferred because it is roll to roll and the polymers can be coated with as many as 15 different layers at once.

The protuberances of the invention may also be manufactured by vacuum forming around a pattern, injection molding or embossing a polymer web.

The image device may be used in combination with other security features to enhance its ability to deter forgery and tampering. Examples of other security features are magnetic strips, holograms, simple and integrated circuits, LCD and LED displays, color gradients, diffraction gratings, and embedded information in the card or the image.

In addition to the added security features of the present invention, it can also be used in signage and unique and interesting display media. This invention can also be used to make a barcode system and decorative mirrors.

The entire contents of the patents and other publications referred to in this specification are incorporated herein by reference.

The following examples illustrate the practice of this invention. They are not intended to be exhaustive of all possible variations of the invention. Parts and percentages are by weight unless otherwise indicated.

EXAMPLES

Example 1

In this example an image device with an image and a pattern of diffuse and specular metallic reflectivity. The image was formed by thermal printing the image onto a thermal transparency film substrate. The pattern of diffuse and specular metallic reflectivity was constructed by taking a polymer base with polymer-filled, metal-coated protuberances covering one surface and using heat and pressure to melt the polymer-filled, metal-coated protuberances to create areas of specular reflectivity. Attaching the image to the pattern of diffuse and specular reflectivity using a pressure sensitive adhesive assembled the image device. This example will show the significant improvement in image device security and customization compared to standard image devices for security.

The thermal image was printed onto Kodak Professional Ektatherm XLS transparency material (a biaxially oriented polyester with a typical polycarbonate dye image-receiving layer). The image was printed utilizing a Kodak 8670 PS Thermal Dye Transfer Printer. Several test images that contained graphics, text, and images were printed on the transparency material. At this point, the thermal dye transfer images were formed on the transparency material.

The base material with a pattern of diffuse and specular reflectivity was constructed by creating a roller with a pattern of depressions (the negative of the desired protuberance pattern) then extruding a molten polymer onto the roller and transferring it to a base material. This base material with protuberances was then metallized and selectively melted, melting the protuberances to form a pattern of diffuse and specular reflectivity.

A patterned roll was manufactured by a process including the steps abrasively blasting the surface of the roll with grit (can be glass or other materials) to create a surface texture with hemispherical features. The resulting blasted surface was chromed to a depth that results in a surface texture with the features either concave into the roll or convex out of the roll. The bead blasting operation was carried out using an automated direct pressure system in which the nozzle feed rate, nozzle distance from the roller surface, the roller rotation rate during the blasting operation and the velocity of the particles are accurately controlled to create the desired complex lens structure. The number of features in the chill roll per area is determined by the bead size and the pattern depth. Larger bead diameters and deeper patterns result in fewer numbers of features in a given area.

The patterned roll was manufactured by starting with a steel roll blank and grit blasted with size 14 grit at a pressure of 447 MPa. The roll was then chrome platted. The resulting pattern on the surface of the roll were convex complex lenses.

The patterned roll was extrusion coated using a polyolefin polymer from a coat hanger slot die comprising substantially 96.5% LDPE (Eastman Chemical grade D4002P), 3% Zinc Oxide and 0.5% of calcium stearate onto a 100 micrometer transparent oriented web polyester web with a % light transmission of 94.2%. The polyolefin cast coating coverage was 25.88 g/m$^2$.

The patterned base material containing complex lenses with randomly distributed lenses comprised a major lens with an average diameter of 27.1 micrometers and minor lenses on the surface of the major lenses with an average diameter of 6.7 micrometers. The average minor to major lens ratio was 17.2 to 1. The average Ra of the complex lens patterned film was 5.2 micrometers.

The patterned polymer protuberances (complex lenses) on the polyester base were then metallized with 50 nanometers of aluminum by vacuum coating.

The metal-coated protuberances were then printed using heat and pressure to change the diffuse reflectivity to specular reflectivity. The protuberances were printed using thermal printing with thermal dye sublimation, Kodak model 8670 PS Thermal Printer. The thermal print head applied heat and pressure to melt the lenses. When the protuberances cool back below the glass transition temperature, they harden in the new more planar state. The heat and pressure melt the lenses causing an almost completely specular reflection area in the film and, at the same time. Color could have been added at the same time the protuberances were melted, but was not in this example. A variety of patterns were creating including text, graphics, and images out of the diffuse and specular areas of metallic reflectivity.

The structure of the base with the pattern of diffuse and specular metallic reflectivity of this example was as follows:

| |
|---|
| Aluminum coating |
| Polyethylene protuberances and selectively flattened polyethylene lenses |
| PET base |

The image and substrate and the pattern of diffuse and specular metallic reflectivity and base were then joined with a pressure sensitive adhesive (PSA). The pressure sensitive adhesive was a permanent water based acrylic adhesive 12 micrometers thick. Though a PSA was utilized in this example, any other form of adhesive such as UV cured or heat activated could have been used. The adhesive joined the image to the pattern of diffuse and specular reflectivity. The substrate of the image and base of the pattern of reflectivity form the outsides of the image device. The structure of the image device is shown below:

| |
|---|
| Substrate |
| Image |
| Adhesive |
| Pattern of diffuse and reflective metallic reflectivity |
| Base |

The image device of this example has many advantages over prior art image devices for security purposes. The image device prevents tampering better than some prior art image devices for security. Prior art devices, such as credit cards, use holograms that are adhered to the front of the devices. These holograms can be taken off and reapplied to other devices to make fake credit cards and IDs. Because the pattern of diffuse and specular reflectivity of the invention is very delicate and adhesively bonded to the image, the pattern of reflectivity is destroyed if it is tampered with or the card is opened. Furthermore, the device is very difficult to photocopy or to scan because the varying amounts of specular reflection will not copy.

The image device also is customizable where prior art security devices tend to be mass-produced. For example, if a hologram is to be used there is a minimum order that can be placed because the hologram master must be created and is expensive. The cards must then all have the same hologram, such as in a driver's license or a credit card. Because the image device of the invention's pattern of diffuse and specular reflectivity is printed, each security feature can be custom printed. This enables short runs of ID cards for smaller companies, or a greater level of security by, for example, adding the driver's name or birth date in specular reflectivity to each driver's license. Furthermore, thermal printers already have a large installation base in the ID card printing industry enabling the ability to print customized patterns of reflectivity for cards by changing the thermal donor and media.

The invention further provides polymer layers that serve as wear resistant surfaces on both sides of the image device to so it will not be easily damaged during handling or use of the image as the image and pattern of reflectivity are below a layer of biaxially oriented polymer. The wear resistant surfaces of the invention provide protection from fingerprinting, spills of liquids, and other environmental deleterious exposures. Prior image devices do not have a wear resistant surface and therefore need an extra step of lamination typically on both sides of the device to provide protection. Lamination requires extra equipment, an extra step in the manufacturing process, and is time and money consuming.

The invention has been described in detail with particular reference to certain preferred embodiments thereof, but it will be understood that variations and modifications can be effected within the spirit and scope of the invention.

Parts List

10 Complex lens
12 Base
14 Generally planar areas
16 Metal layer
18 Adhesive layer
20 Image layer
22 Substrate
24 Pyramidal shaped protuberances

What is claimed is:

1. An image device comprising a base material, said base material comprising a metal coated transparent polymer sheet having a pattern of diffuse metallic reflectivity and specular metallic reflectivity and overlaying said pattern an image.

2. The image device of claim 1 wherein said pattern of diffuse metallic reflectivity and specular metallic reflectivity comprises surface features wherein said diffuse reflectivity areas comprise metal-coated protuberances and said specular reflective areas comprise planar areas in generally the plane of said base.

3. The image device of claim 2 wherein in said pattern of diffuse metallic reflectivity and specular metallic reflectivity the diffuse reflection efficiency differs by an amount greater than 60% from the diffuse to the specular areas.

4. The image device of claim 3 wherein areas of specular reflectivity further are provided with a colored layer.

5. The image device of claim 2 wherein said protuberances comprise polyolefin.

6. The image device of claim 1 wherein said pattern of diffuse and specular metallic reflectivity comprises diffuse reflection efficiency, and differs by an amount greater than 20% from the diffuse to the specular areas.

7. The image device of claim 1 wherein said metallic reflectivity is from metal thickness of between 10 and 5000 angstroms.

8. The image device of claim 1 wherein said metallic reflectivity is from metal thickness of between 500 and 1000 angstroms.

9. The image device of claim 1 wherein said base having areas of diffuse and specular reflectivity has a scratch sensitivity of less than 0.1 Gpa.

10. The image device of claim 1 wherein said metallic reflectivity is from silver or aluminum.

11. The image device of claim 1 wherein the areas of specular reflectivity provide graphics, text, or image.

12. The image device of claim 1 wherein said reflective area further comprises fluorescent or phosphorescent materials in the areas of specular reflectivity.

13. The image device of claim 1 wherein areas of specular reflectivity have resistivity of between 50 and 2500 ohms per square.

14. The image device of claim 1 wherein said image device further is provided with conductive leads from the areas of specular reflectivity to an exposed surface of said device.

15. The image device of claim 1 wherein the overlaying of said pattern is accomplished by providing a substrate having an image adhered thereto.

16. The image device of claim 15 wherein said substrate comprises a substantially transparent polymer sheet.

17. The image device of claim 16 wherein said transparent polymer sheet is on an outer surface of said device.

18. The image device of claim 1 wherein said image comprises an image formed by thermal transfer.

19. The image device of claim 1 wherein said image is adhered to said base such that the image is in registration with said pattern of diffuse and specular reflective areas.

20. The image device of claim 1 wherein the image overlaying of said pattern is accomplished by providing a substantially transparent polymer substrate having a thermal image adhered thereto which is adhesively attached to said diffuse and specular reflective areas such that said base material and said substrate form the outer surfaces of said image device.

21. A method of forming an image device comprising providing a base material said base material comprising a metal coated polymer sheet having a pattern of diffuse metallic reflectivity and specular metallic reflectivity, providing a substrate having an image thereon, and adhesively connecting said base and said substrate.

22. The method of claim 21 wherein said pattern of diffuse and specular metallic reflectivity is in contact with said adhesive.

23. The method of claim 22 wherein said image is in contact with said adhesive.

24. The method of claim 22 wherein said base material comprises a substantially transparent polymer.

25. The method of claim 22 wherein said pattern of diffuse metallic reflectivity and specular metallic reflectivity comprises surface features wherein said diffuse reflectivity areas comprise metal-coated protuberances and said specular reflective areas comprise planar areas in generally the plane of said base.

26. The method of claim 25 wherein in said pattern of diffuse metallic reflectivity and specular metallic reflectivity diffuse reflection efficiency differs by an amount greater than 60% from the diffuse to the specular areas.

27. The method of claim 25 wherein said protuberances comprise polyolefin.

28. The method of claim 22 wherein said metallic reflectivity is from metal thickness of between 500 and 1000 angstroms.

29. The method of claim 22 wherein said base having areas of diffuse and specular reflectivity has a scratch sensitivity of less than 0.1 Gpa.

30. The method of claim 22 wherein said metallic reflectivity is from silver or aluminum.

31. The method of claim 22 wherein the areas of specular reflectivity provide graphics, text, or image.

32. The method of claim 22 wherein areas of specular reflectivity have resistivity of between 50 and 2500 ohms per square.

33. The method of claim 22 wherein said image device further is provided with conductive leads from the areas of specular reflectivity to an exposed surface of said device.

34. The method of claim 22 wherein said image comprises an image formed by thermal transfer.

35. The method of claim 22 wherein said image is adhered to said base such that the image is in registration with said pattern of diffuse and specular reflective areas.

36. The method of claim 35 wherein the image overlaying of said pattern is accomplished by providing a substantially transparent polymer substrate having a thermal image adhered thereto which is adhesively attached to said diffuse and specular reflective areas such that said base material and said substrate form the outer surfaces of said image device.

37. The method of claim 1 wherein said substrate compress a substantially transparent polymer sheet.

* * * * *